US005178222A

United States Patent [19]

Jones et al.

[11] Patent Number: 5,178,222

[45] Date of Patent: Jan. 12, 1993

[54] DRILL BIT HAVING ENHANCED STABILITY

[75] Inventors: Mark L. Jones, Midvale; Wayne R. Hansen, Centerville, both of Utah

[73] Assignee: Baker Hughes Incorporated, Houston, Tex.

[21] Appl. No.: 728,641

[22] Filed: Jul. 11, 1991

[51] Int. Cl.[5] ..... E21B 10/46

[52] U.S. Cl. ..... 175/398; 175/431

[58] Field of Search ..... 175/329, 398, 399, 408, 175/396, 431; 76/108.2, 108.4

[56] References Cited

U.S. PATENT DOCUMENTS 3,106,973 10/1963 Christensen .
3,220,497 11/1965 Mori et al. .
3,825,083 7/1974 Flarity et al. .
4,244,432 1/1981 Rowley et al. .
4,352,400 10/1982 Grappendorf et al. .
4,815,342 3/1989 Brett et al. .
4,869,330 9/1989 Tibbitts .
4,883,132 11/1989 Tibbitts .
4,884,477 12/1989 Smith et al. ..... 76/108.2
4,913,244 4/1990 Trujillo .
4,913,247 4/1990 Jones .
4,932,484 6/1990 Warren et al. ..... 175/398 X
4,941,538 7/1990 King .
4,981,184 1/1991 Knowlton et al. .
5,004,057 4/1991 Tibbitts .
5,010,789 4/1991 Brett et al. .

FOREIGN PATENT DOCUMENTS 351699 1/1990 European Pat. Off. ..... 175/329

*Primary Examiner*—David J. Bagnell
*Attorney, Agent, or Firm*—Trask, Britt & Rossa

[57] ABSTRACT

The present invention is a drill bit having a multi-level gage defining the outermost radius of the bit, at least one portion of the gage extending longitudinally closer to the bit face than another portion.

8 Claims, 4 Drawing Sheets

DRILL BIT HAVING ENHANCED STABILITY

BACKGROUND OF THE INVENTION

Field of the Invention

The present invention relates to drill bits for boring subterraneous formations, and specifically to fixed cutter rotary drag bits.

State of the Art

Fixed cutter rotary drag bits have been employed for boring subterraneous formations for many decades, and are particularly suited for drilling oil and gas wells, where they are widely employed. Over the past ten to fifteen years, synthetic diamond cutting elements, generally referred to as polycrystalline diamond compacts, or PDC's, have become the most widely employed cuter type. Such cutting elements may be square, triangular, or other polyhedral shape, but the predominant design is a circular PDC having a planar cutting face backed by a disc or cylinder of metal, such as tungsten carbide. Such cutting elements are secured to the crown or face of the drill bits either by brazing into pockets on the bit face, or by securing the element to a stud which is then inserted in a socket in the bit face. Recently, circular PDC elements which are thermally stable to relatively high temperatures have become available, and such elements may be secured into the face of a matrix-type bit at the time the bit is furnaced.

It is possible to calculate with some accuracy the force generated by a cutter engaging a formation and to break the force into triaxial components, two of which, tangential and radial forces (the third being along the axis of the bit) act into or away from the center of the bit. When summed with those like forces of the other cutters on the face of the bit, the magnitude and direction of the total side forces in a plane perpendicular to the bit axis may be determined. Such calculations generally take into consideration the cutting element size, radial placement, back (or forward) rake, as well as anticipated rotational speed of the bit, weight on the bit and formation type. It is thereby possible to ascertain with some certainty whether or not the sum of the side forces will tend to cause bit imbalance, which sometimes will cause a bit to "wobble" in the wellbore, cutting an oversize borehole, or to "walk" in a particular direction, so that the borehole gradually deviates from a linear path. A fairly detailed explanation of the manner in which such forces may be calculated and summed to indicate any force imbalance is provided by U.S. Pat. No. 4,815,342, assigned to Amoco Corporation.

In former times, where seismic, logging and survey techniques were less refined, borehole deviation was often unrecognized, or was not perceived as a problem. However, in the current drilling environment, wherein seismic logging and survey techniques have been developed to such a degree that potential producing formations may be identified with an enhanced degree of certainty, the industry has recognized that drill bits with greater drilling accuracy are highly desirable.

Accuracy is further desirable due to the current tendency to drill infill wells in existing fields, and to drill a large number of wells, in some cases as many as one hundred, from a single offshore platform. In both situations, intersection of an existing borehole by a second borehole being drilled will result in a blowout, with catastrophic property damage, injury to personnel if not loss of life, and severe environmental damage.

Finally, current industry practice of deploying so-called steerable drilling systems including a downhole motor, whereby the operator may drill both linear and non-linear boreholes using the same bottom hole assembly, places a premium on drill bits which hold to the course directed by the bottom hole assembly.

In addition to the aforementioned problems of bit wobble and bit walk, it has also been observed that a bit having imbalanced cutter side forces may rotate or "whirl" in the borehole about a center point offset from the geometric center of the bit in such a manner that the bit tends to whirl backwards about the borehole. The whirl phenomenon has been observed to be aggravated by the presence of gage cutters or trimmers at certain locations on the gage of the bit, which also generate frictional forces during drilling. Whirl is a dynamic and self-sustaining phenomenon, and in many instances is highly destructive to the drill bit cutters.

Several different approaches have been taken to producing a bit that will drill without the aforementioned performance deficiencies, both of which are exemplified by U.S. patents issued to Amoco Corporation. In one case, as disclosed in previously-referenced U.S. Pat. No. 4,815,342, a bit is produced, the cutting element locations and other parameters are measured, the resultant forces calculated, and one or more cutting elements added to bring the bit into a balanced state with respect to the lateral or side forces generated by the cutting elements. Stated another way, the method seeks to produce a zero force vector in the plane perpendicular to the axis of the bit. A second approach, as disclosed in U.S. Pat. No. 5,010,789, is to place and orient the cutting elements so that the lateral or side force vector is intentionally directed to one side of the bit, which includes a bearing surface in substantially constant contact with the wall of the borehole. This latter methodology evolved from the industrial technique of "gun drilling," used to drill perfectly straight bores in heavy guns such as are employed on naval vessels. Bits employing a directed side force vector in the manner described have become known in the art as "anti-whirl" bits. Both of the foregoing approaches have also employed the technique of removing rather than adding cutting elements to modify the magnitude and direction of forces in the radial plane perpendicular to the axis of the bit.

While an improvement over the prior art, bits manufactured according to either of the above methodologies still experience operational problems, including but not limited to deviational tendencies, to the point where many of their advantages have yet to be fully exploited, and the cause for such problems has apparently not been ascertained. In addition, the existence of large and directed side forces in anti-whirl bits has been observed by the inventors herein to cause cocking or tilting of the bits in the borehole, and also to cause excessive and premature wear on the portion of the bit gage in contact with the borehole wall, especially at the lowermost portion of the gage.

SUMMARY OF THE INVENTION

The present invention recognizes the fact that the lateral or side forces acting upon a fixed cutter rotary drag bit are generated at the lowermost edges of the cutting elements at their point of contact with the formation being drilled, and provides a bit design which takes advantage of this recognition to enhance the performance of the bit.

In conventional round profile bit designs, the gage of the bit is longitudinally separated from the cutters on the face of the bit by a substantial distance. The gage pads, which provide stability for the rotating bit, are thus far removed from the lateral force vectors, the result being comparable to exerting a force on a long lever arm, which multiplies the applied force. Thus, in a balanced bit, any residual imbalance is magnified, and in an intentionally unbalanced bit, such as the so-called "anti-whirl" bits described above, the effect of the side force vector is unintentionally enhanced. Conventional bit designs, while employing a number of gage pads, terminate all of the gage pads at a substantially uniform distance above the bit face or profile due to the necessity of providing gage cutters or trimmers at the periphery of the bit face to ensure that the bit drills a full gage borehole. In fact, in conventional designs, all gage cutters or trimmers are located above all of the cutters on the face of the bit.

The present invention provides a bit design wherein at least a portion of the gage of the bit is extended downwardly (taken in the bit's normal operating orientation) toward the profile or face of the bit. In a "balanced" bit, the extended gage may take the form of evenly spaced extended gage pads interspersed with conventional, shorter gage pads on the periphery of the bit. In an unbalanced, anti-whirl design, the extended gage may take the form of an extended pad or pads on the side or circumferential portion of the bit toward which the side force vector is intentionally directed. It is desirable on anti-whirl bits that the extended gage portion be devoid of cutting elements so as to minimize bearing surface friction against the borehole wall. In some bit designs in accordance with the present invention, some of the cutting elements on the bit face may be located substantially at or even above the lowermost level of a portion of the bit gage.

Stated another way, the present invention comprises a drill bit having circumferentially offset gage pads terminating at least two different elevations above the bit face. The shorter gage pads may provide for gage cutters or trimmers, while the longer, extended gage pads provide an enhanced bearing surface to support the bit against the borehole wall to minimize gage wear and to prevent cocking of the bit with respect to the borehole axis. In an anti-whirl bit, the extended gage pads would desirably be devoid of gage trimmers, but in a balanced bit design, this is not necessarily a requirement of the invention.

DETAILED DESCRIPTION OF THE PREFERRED EMBODIMENTS

Figure 4:
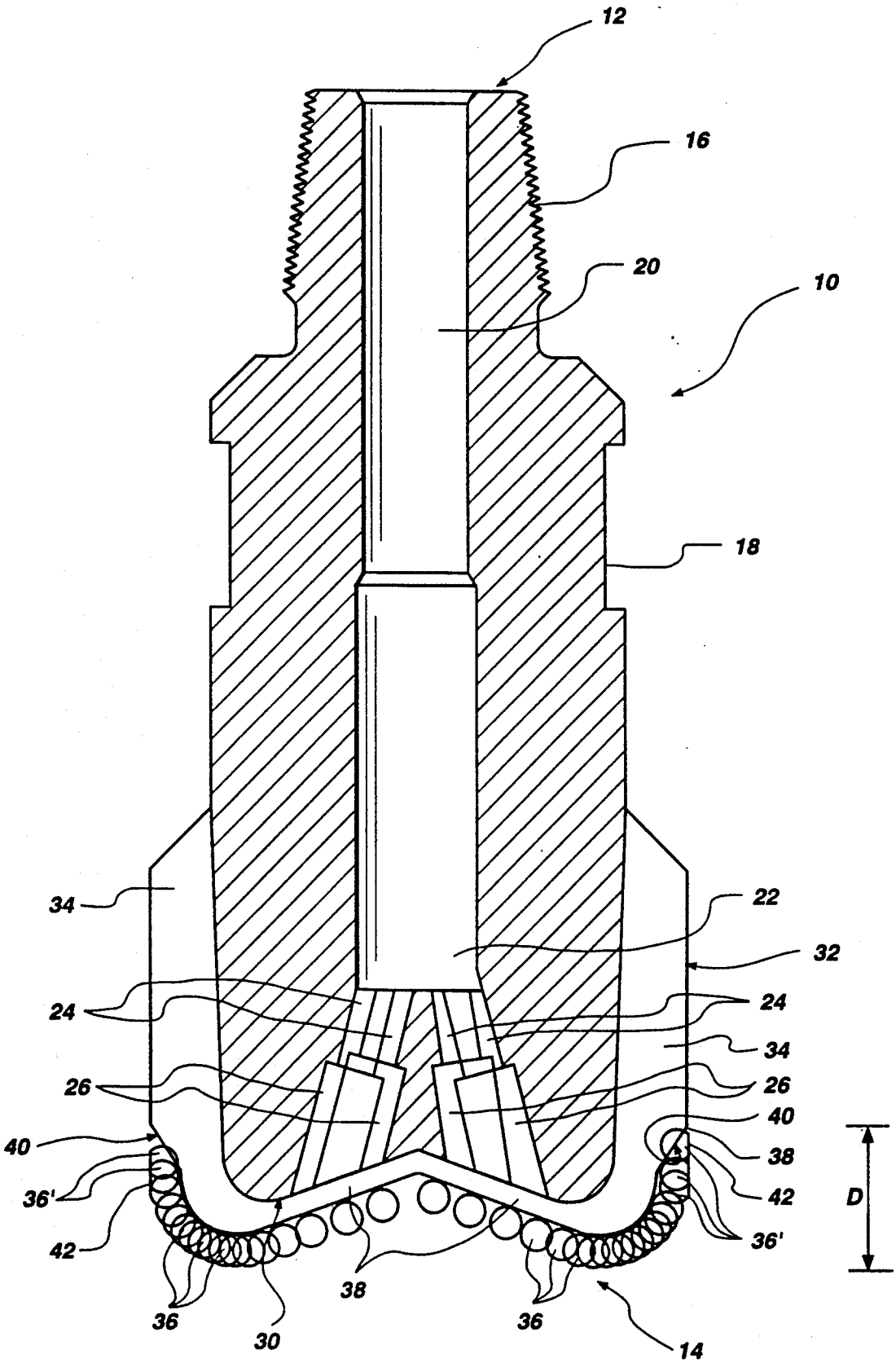
FIG. 4 comprises a schematic of a bit including the crown of FIG. 1, showing the radial cutting element placement on the bit profile.

Referring first to FIG. 4 of the drawings, drill bit 10 generally includes a number of components exemplary of substantially all fixed cutter rotary drag bits. Drill bit 10 includes a pin end 12 and a crown end 14, pin end 12 having exterior threads 16 thereon by which bit 10 is made up with a drill collar or the drive shaft of a downhole motor (not shown). Flats 18 below the pin end 12 serve as gripping surfaces by which the bit 10 is secured during the make-up process. Axial bore 20 extends from the pin end 12 to a plenum area 22 which feeds schematically illustrated flow passages 24 and nozzles or outlets 26 (shown in FIG. 4 in overlapping or superimposed relationship). Nozzles or outlets 26 direct drilling fluid, also referred to as drilling "mud," to waterways 28 on the face or profile 30 of bit 10, waterways 28 extending from the center of the bit toward the periphery or gage 32 thereof. Waterways 28 communicate with junk slots 34 in the gage 32. As the drilling mud washes across the face of the bit 10, it serves to cool and clean PDC cutting elements 36 (shown in overlapping relationship to indicate the rotational paths of all of the cutting elements on the bit face) and to direct formation cuttings from elements 36 and the face 30 of the bit 10 radially outward to junk slots 34, to be carried upwardly in the borehole annulus between the drill string and the borehole wall.

It will be noted in FIG. 4 that the lowermost point 38 of gage 32, separated from profile or face 30 by angled indent 40, is shown to terminate a substantial distance $D_1$ from the edges of the cutting elements 36 on the bit face 30, particularly from the axially or vertically protruding elements 36 which generate the majority of the side forces on bit 10. Some of the cutting elements, termed gage trimmers and specifically denoted as elements 36', extend up the outer portion of the bit face and normally include flat or axially-extending edges 42 for cutting or trimming the borehole to its full diameter. In the view of FIG. 4, the extended portion of the bit gage is not shown so that all cutting element positions may be shown.

Figure 1:
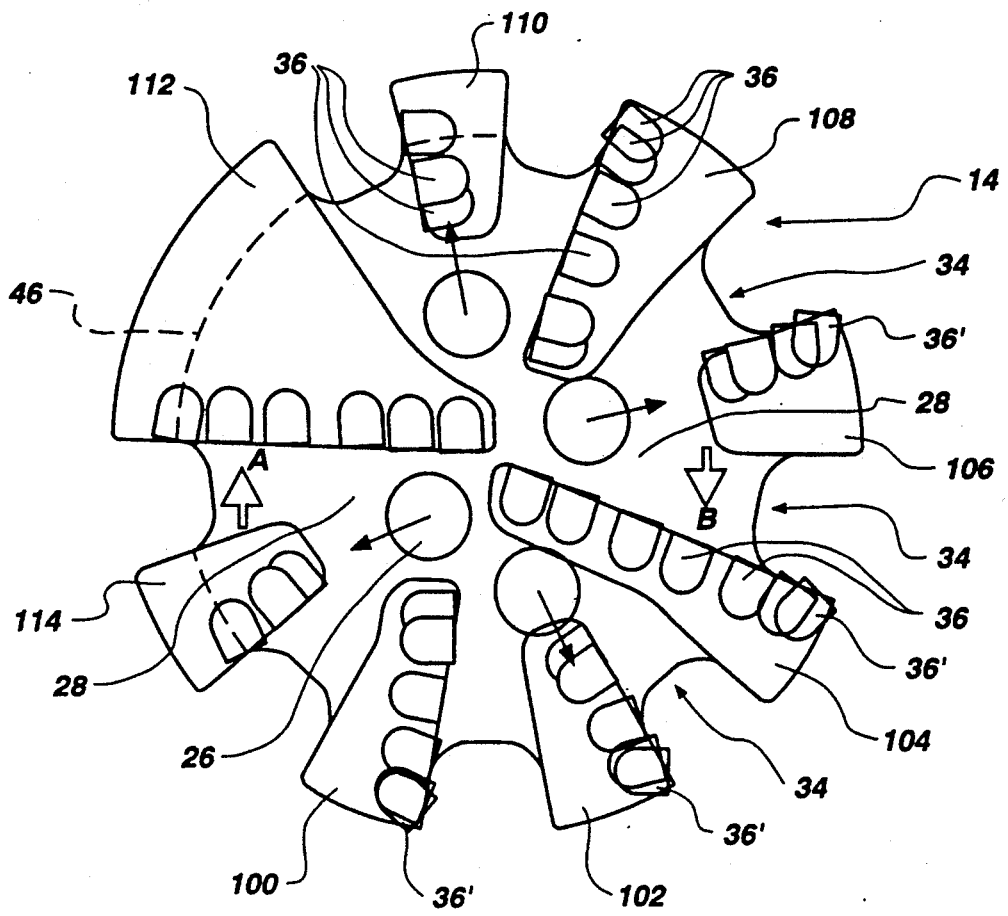
FIG. 1 comprises a schematic bottom elevation of the crown of an anti-whirl drill bit having an extended gage portion according to the present invention.

Referring now to FIG. 1 of the drawings, the face or profile 30 of bit 10 is shown. On bit 10, by way of example and not limitation, eight gage pads, 100 through 114, are employed. Pads 100 through 108 are of a short, or conventional length, as illustrated in FIG. 4 and in more detail on the right-hand side of FIG. 2, designated "View B" and taken in the direction of arrow B in FIG. 1. Pads 100–108 include gage trimmers 36' or full-diameter PDC cutting elements 36 extending substantially to the gage 32. Pads 110, 112 and 114, on the other hand, as shown in FIG. 1 and on the left-hand side of FIG. 2, designated "View A," extend the gage 32 substantially to the bit face 30, being separated therefrom only by short, radiused edge 44, the distance between extended gage point 38' and the lowermost extending cutting element being substantially shorter distance $D_2$ (see FIG. 2). It should also be noted that gage pads 110, 112 and 114 are devoid of gage trimmers 36', that the outermost cutting elements 36 on pads 110, 112 and 114 are located well away from gage 32 and are preferably disposed so that at least a portion thereof is located within bit face 30, the outermost periphery thereof being shown, as it pertains to pads 110, 112 and 114, by broken line 46 on FIG. 1 and point 46 on FIG. 2. The gage pads which extend closer to the bit face may, in fact, be shorter than those which terminate at a greater distance from the bit face, the critical portions of the extended gage pads being those closest to the bit face.

Figure 3A:
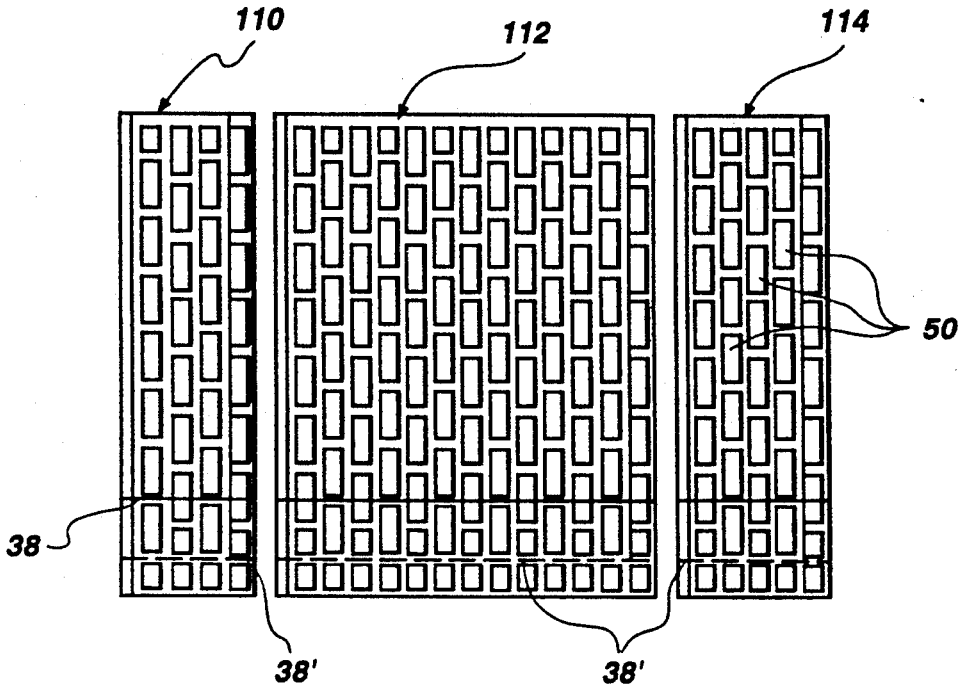
FIGS. 3A and 3B comprise planar depictions of side elevations of the extended and conventional gage pads as employed in the bit crown of FIG. 1.
Figure 3B:
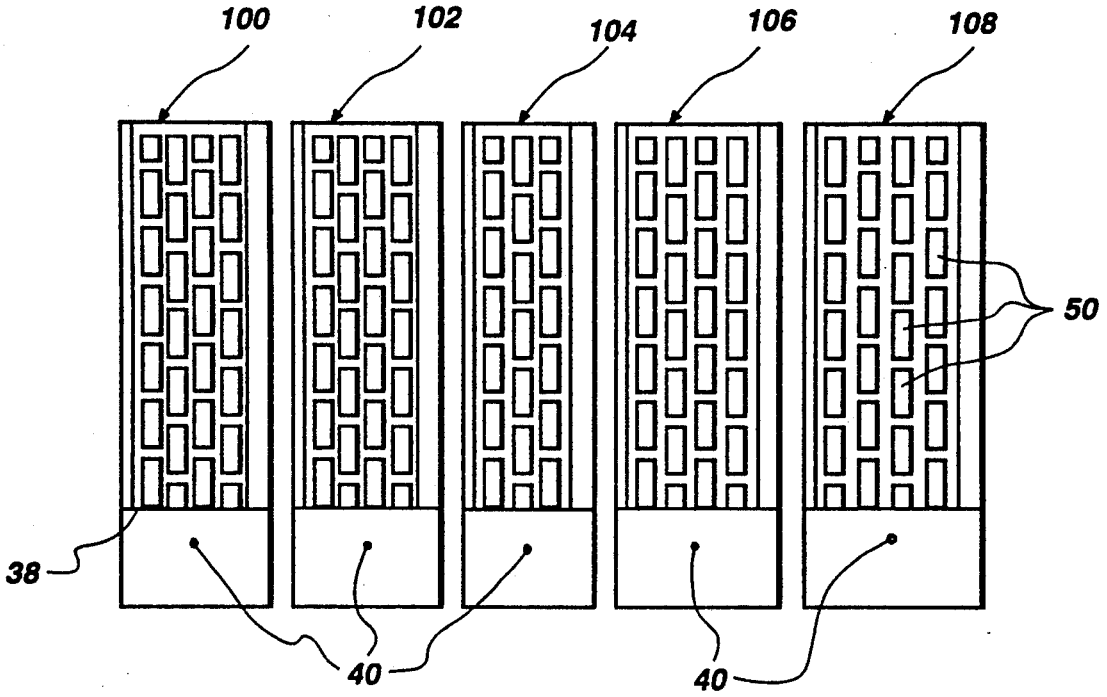

FIGS. 3A and 3B depict, in planar form, the exterior surfaces of gage pads 110, 112 and 114 (FIG. 3A) and 100, 102, 104, 106 and 108 (FIG. 3B). All of the gage pads include tungsten carbide bricks or inserts 50 in the surface thereof, to provide wear surfaces as bit 10 rotates in the wellbore. Other suitable materials for inserts 50 may also be employed, including but not limited to natural diamonds, thermally stable synthetic diamonds, silicon carbide, boron nitride, and other ceramics of various types. FIGS. 3A and 3B clearly illustrate the extension of the gage on pads 110, 112 and 114 to point 38' from the normal gage point 38 on pads 100, 102, 104, 106 and 108. Thus, the present invention may be described by way of example and without limitation, as a two-level gage design for a drill bit, the term "level" being defined as the distance above the cutting face at which a gage pad defines a radius substantially equal to the maximum radius of the drill bit.

Figure 2:
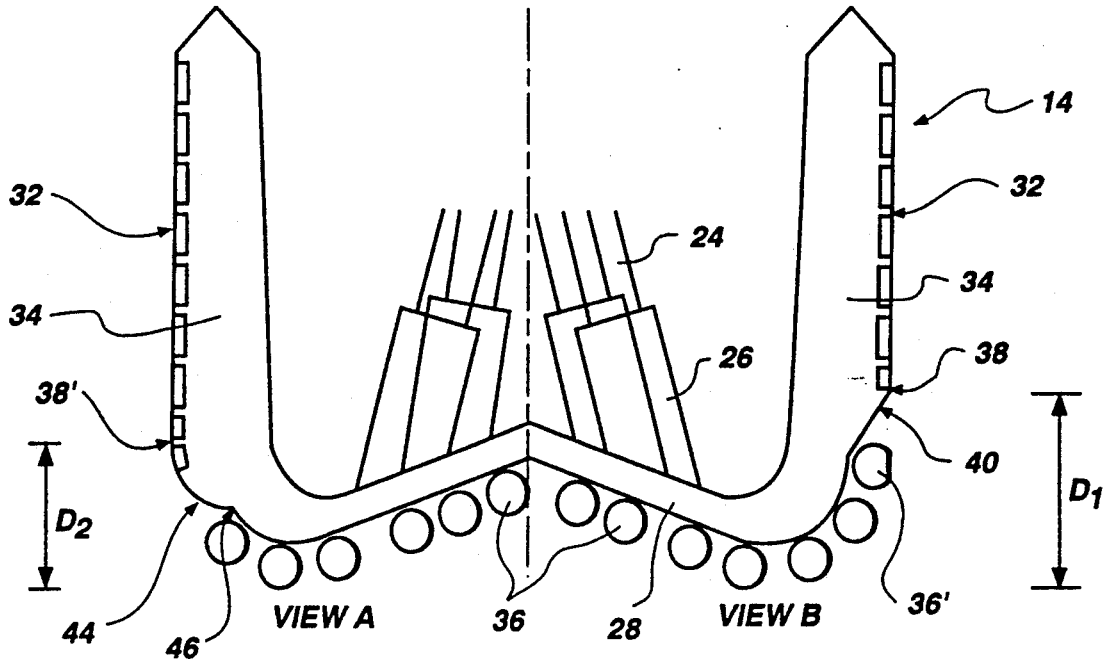
FIG. 2 comprises a schematic sectional view of the bit crown of FIG. 1 depicting both extended and conventional gage portions as employed therein.

Extension of the gage or the use of a two-level gage may be applied to a balanced drill bit design, for example, by including a number of peripherally spaced gage pads, and interposing extended pads as shown in View A of FIG. 2 with short, conventional pads as shown in View B of FIG. 2. The extended and conventional pads may be of the same width, or the extended pads may be wider so as to provide an even greater bearing surface. The extended pads may also include gage trimmers, although it is preferred that the gage trimmers be concentrated ,on the shorter pads.

Figure 5:
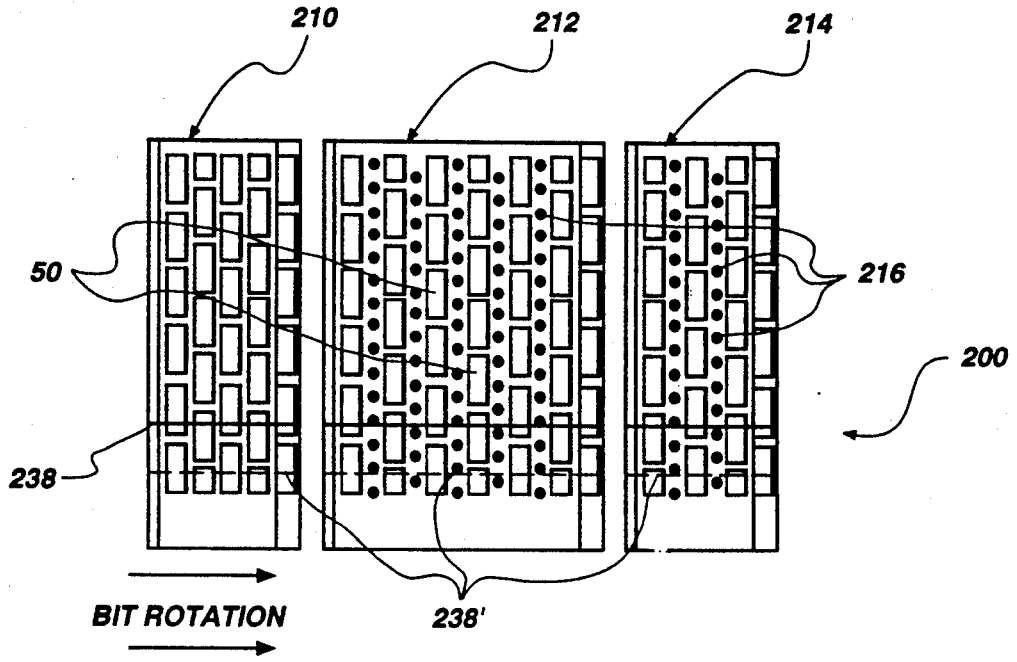
FIG. 5 comprises a planar depiction of a side elevation of an alterative extended gage pad according to the present invention.

FIG. 5 illustrates an alternative extended gage design 200 including pads 210, 212 and 214; the major distinction between the design of FIG. 3A and FIG. 5 being the inclusion of flush set natural diamonds 216 on pads 212 and 214 in alternating rows with tungsten carbide inserts 50. Of course, the natural diamonds (or other diamonds, such as so-called thermally stable products, or TSP's, which are available in a variety of configurations, including round, triangular and rectangular) may be disposed in patterns other than rows, and may be concentrated at the lowermost portion of the gage between the normal gage point 238 and the extended gage point 238'. Such alternatives are especially suitable for enhancing the bearing surface used with the directed force vector of an anti-whirl bit.

Figure 6:
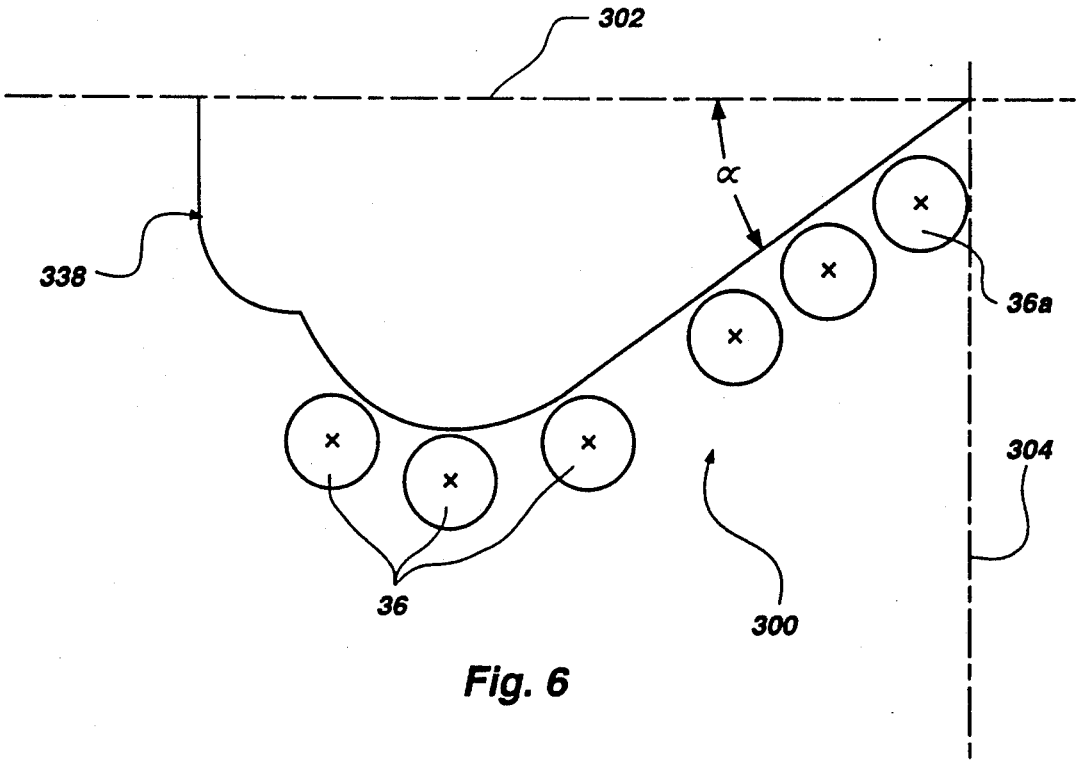
FIG. 6 comprises a schematic half-sectional view of an additional embodiment of a bit profile and extended gage according to the present invention.

FIG. 6 illustrates an alternative profile and extended gage of a bit 300 in accordance with the present invention. Bit 300 includes a very steep profile disposed at an angle $\alpha$ which as shown is substantially 35° from radial plane 302. Thus, the extended gage point 338 lies substantially radially adjacent innermost cutting element **36*a* adjacent the center line 304 of bit 300**. Depending upon the choice of angle $\alpha$ and the diameter of the bit, it is contemplated that an extended gage point may even lie below some of the cutting elements toward the center of the bit.

In operation, a drill bit according to the present invention is employed in the same manner as any conventional dill bit, the advantage of the extended gage of the present invention being realized by increased directional stability, reduction of vibration and bit wobble, and elimination of bit cocking in the borehole.

While the invention has been disclosed in terms of a preferred embodiment, the skilled artisan will appreciate that it is not so limited, and that many additions, deletions and modifications may be made thereto without departing from the spirit and scope of the invention as claimed.

What is claimed is:

1. A rotary drill bit for subterranean earth boring, comprising:

a crown disposed below a pin, said rotary drill bit defining a longitudinal axis therebetween;

a face on said crown extending from said longitudinal axis radially outwardly and terminating in a longitudinally extending gage defining the diameter of said bit, said face including a first peripheral portion having cutting elements disposed thereon immediately adjacent and extending radially outwardly to said diameter and a second peripheral portion being devoid of cutting elements in the area immediately adjacent said diameter, said gage at said second peripheral portion extending longitudinally downwardly to a radial plane adjacent that of said cutting elements on said first peripheral portion.

2. The drill bit of claim 1, wherein said gage adjacent said second peripheral face portion extends a greater longitudinal distance than said gage adjacent said first peripheral face portion.

3. The drill bit of claim 1, wherein said gage adjacent said first peripheral face portion extends a greater longitudinal distance than said gage adjacent said second peripheral face portion.

4. The drill bit of claim 1, wherein said gage comprises gage pads separated by longitudinally extending junk slots in communication with said bit face.

5. A rotary drill bit for boring subterranean formations, comprising:

a pin having a crown disposed thereon, together defining a longitudinal bit axis;

said crown including a face extending radially outwardly from said longitudinal bit axis and peripherally terminating at a longitudinally extending gage; and cutting elements disposed on said bit face proximate said longitudinal bit axis, said gage extending longitudinally toward said face to a position at least radially adjacent to said cutting elements proximate said longitudinal bit axis.

6. The rotary drill bit of claim 5, wherein said gage extends longitudinally beyond the radial plane whereon at least one of said cutting elements proximate said longitudinal bit axis is located.

7. A drill bit for boring subterranean formations, comprising:

a longitudinal bit axis;

a pin having a crown secured therebelow, said crown having a gage, and a profile disposed at an angle $\alpha$ from a radial plane transverse to said bit axis; said profile having cutting elements disposed thereon proximate said bit axis; and said profile angle $\alpha$ being sufficiently large that said profile and said gage meet at a point substantially radially adjacent at least one of said cutting elements proximate said bit axis.

8. The drill bit of claim 7, wherein said profile and said gage meet at a point on a radial plane below that of at least one of said cutting elements proximate said bit axis.

* * * * *